US010968094B2

(12) United States Patent
Kessler et al.

(10) Patent No.: US 10,968,094 B2
(45) **Date of Patent: *Apr. 6, 2021**

(54) UNIVERSAL MANIFOLD FOR DELIVERING HAZARDOUS LIQUID

(71) Applicant: Cole-Parmer Instrument Company LLC, Vernon Hills, IL (US)

(72) Inventors: Justus Kessler, Lake Elsinore, CA (US); Jason Touhy, Winchester, CA (US)

(73) Assignee: COLE-PARMER INSTRUMENT COMPANY LLC, Vernon Hills, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/033,525

(22) Filed: Sep. 23, 2013

(65) Prior Publication Data

US 2015/0083274 A1 Mar. 26, 2015

(51) Int. Cl.
*B67D 7/02* (2010.01)

(52) U.S. Cl.
CPC .... *B67D 7/0288* (2013.01); *B67D 2210/0006* (2013.01)

(58) Field of Classification Search
CPC ..... B67D 7/0288; B67D 7/36; G01N 30/00; G01N 30/04
USPC ..... 141/84, 236, 311 R, 367, 383–386; 215/309, 319; 220/287–288, 304, 374, 220/367.1, 86.1
See application file for complete search history.

(56) References Cited

U.S. PATENT DOCUMENTS

| | | | | |
|---|---|---|---|---|
| 3,019,932 | A * | 2/1962 | Singiser | B65D 47/06 215/309 |
| 3,293,773 | A * | 12/1966 | Frazer | F26B 5/06 34/92 |
| 3,498,310 | A * | 3/1970 | Hechler | A01C 23/042 137/218 |
| 5,474,098 | A * | 12/1995 | Grigorian | B01D 35/306 123/198 A |
| 7,563,243 | B2 * | 7/2009 | Mendels | A61M 39/10 604/80 |
| 8,985,360 | B2 * | 3/2015 | Chen | B67D 7/06 141/311 R |
| 10,526,192 | B2 * | 1/2020 | Holley | B67D 7/344 |
| 2015/0353339 | A1 * | 12/2015 | Kessler | G01N 30/04 141/236 |

* cited by examiner

*Primary Examiner* — Timothy P. Kelly
(74) *Attorney, Agent, or Firm* — Arent Fox LLP

(57) ABSTRACT

The current invention teaches a universal manifold for delivering chemical liquids to a storage container. The universal manifold contains a universal mating system that enables a single manifold to attach to a number of variously sized storage containers that include a number of variously sized fill apertures. This enables the use of the same universal manifold for the delivery and collection of liquid chemical to the storage container at different times.

4 Claims, 6 Drawing Sheets

UNIVERSAL MANIFOLD FOR DELIVERING HAZARDOUS LIQUID

FIELD OF INVENTION

The present invention relates to chemical liquid storage containers that are used for delivering and collecting chemical liquid. More specifically the present invention discloses a universal manifold that enables the delivery and collection of chemical liquid by way of a storage container. The universal manifold includes a mating system that mates the universal manifold to a storage container whereby the universal manifold is enabled to mate with multiple types of storage containers having various sizes of fill apertures which are often used in high performance chemical liquid chromatography laboratories.

BACKGROUND OF THE INVENTION

High performance chemical liquid chromatography, also known as high pressure chemical liquid chromatography and HPLC, is a commonly used analytical procedure and machine which involves the use of a plurality of different chemical liquids whereby a plurality of different chemical liquids flow through the chromatograph to analyze the chemical composition of the plurality of different chemical liquids. HPLC also requires the use of a storage container in which, upon completion of the analytical procedure, the plurality of different chemical liquids is accumulated and stored. Furthermore it is common for the plurality of different chemical liquids to include at least one chemical liquid that is hazardous.

It is known in the art that a storage container for storing chemical liquids from an HPLC machine must be fully sealed to prevent the chemical liquids from evaporating into the atmosphere. This is even more important when a hazardous chemical liquid is used. Over time the hazardous chemical liquid will also evaporate into the atmosphere, and may come into contact or even be inhaled by humans and animals. Inhaling hazardous chemical liquid vapor is even more likely when the plurality of different chemical liquids is stored within an enclosed or semi-closed environment like a laboratory.

Caps and filtration systems that reside on the storage container in an effort to seal the storage, container have been devised to reduce and even eliminate chemical liquid from evaporating into the environment. Over time, caps were further developed to enable the insertion of a supply tube in an effort to seal the storage container while still supplying chemical liquids. The purpose of the supply tube is to transport chemical liquids from the HPLC machine to the storage container when collecting. The supply tube was also designed to insert directly through a hole in the cap and into the storage container. Multiple holes in caps were then developed such that one storage container may receive a plurality of chemical liquids. Furthermore it was found that providing a means for securing the supply tube to the cap was desirable. Therefore ports were developed in the cap which often comprise of a threaded means to enable a secure method of attaching a supply tube to the cap.

Although the further developments in caps as described above have reduced and even eliminated hazardous chemical liquid from evaporating into the environment when using a storage container to accumulate and store chemical liquids from an HPLC machine or a machine that requires an accumulation and storage means for chemical liquids or solvents, the caps still have limitations.

One limitation in the design is realized when a plurality of supply tubes are attached to a cap where the number of supply tubes are limited by the surface area of the cap. Furthermore, when a plurality of supply tubes are attached to a cap, attaching each additional tube becomes difficult due to the limitation of space for one's fingers or for tools to enable the attachment of the supply tube to the cap.

Another limitation is realized when identifying a storage container. There are many variously sized storage containers available in the market to facilitate the larger and smaller capacity requirements, storage area constraints in a laboratory, chemical liquid types and even storage containers that store chemical liquids for the delivery of chemical liquids to a machine. The variously sized storage containers also contain variously sized fill apertures in which the cap attaches to the storage container. These result in requiring a multitude of caps that are specific to the size of storage containers.

SUMMARY OF THE INVENTION

The present invention relates generally, to a universal manifold that enables the delivery and collection of chemical liquid. More specifically, it is known in the art that delivery means the delivery of chemical liquid from a storage container to a machine and collection means the collection of chemical liquids from a machine to a storage container. The present invention provides a universal manifold that enables the delivery and collection of chemical liquid to and from a storage container removing the need to use two separate caps. The invention will be disclosed in the context of a universal manifold for a storage container that consists of a universal manifold with a plurality of ports for supply lines to be used for delivery and collection of chemical liquid to machine but it should be understood that the invention is useable in various applications where storage containers are required and is not limited to an HPLC machine. One more particularly innovative aspect of the present invention relates to design of the universal manifold such that the universal manifold includes multiple ports for attaching supply tubes while also enabling more space for fingers and tools to attach supply lines to the ports. This is accomplished by providing an angled plane whereby such angle enables the ports to be directed away from the center of the manifold thereby offering additional space for fingers and tools.

Another innovative aspect of the present invention is the universal manifold contains a mating system that is smartly configured to accept exchangeable washers that may vary in outside diameter size such that the universal manifold is capable of attaching to variously sized storage containers with variously sized fill apertures.

Another particularly important aspect of the invention related to providing a universal manifold that is capable of attaching to variously sized fill apertures is the ability to provide a universal manifold that is capable of attaching to older storage containers that have non-standardly sized fill apertures. This reduces the costs associated with producing a custom cap for each variously sized storage container that consists of variously sized fill apertures.

Another particularly important aspect of the invention related to providing a universal manifold that is capable of attaching to variously sized storage containers where the same universal manifold may be used for the delivery and collection of liquid chemicals to the storage container at different times. Additionally, in the event the aperture of the chemical liquid storage container for delivery is a different size than the aperture of the chemical liquid storage container for collection the same universal manifold can be used by changing the exchangeable washer in the mating system of the universal manifold.

BRIEF DESCRIPTION OF THE DRAWINGS

In the accompanying drawings that form a part of the specification and that are to be read in conjunction therewith and in which like reference numerals are used to indicate like parts in the various views.

DETAILED DESCRIPTION OF THE DRAWINGS

The following detailed description is merely exemplary in nature and is not intended to limit the invention or the application and uses of the invention. Furthermore, there is no intention to be bound by any expressed or implied theory presented in the preceding technical field, background, brief summary or the following detailed description.

A portion of the invention may be described herein in terms of steps. It should be appreciated that such steps may be realized by alternative order.

The overall purpose of the universal manifold described herein is to provide a universal manifold for attaching to variously sized storage containers with variously sized fill apertures for transporting chemical liquid and that also contains multiple ports for attaching supply tubes while providing adequate space for fingers and tools to attach supply tubes to the multiple ports thereof.

Figure 1:
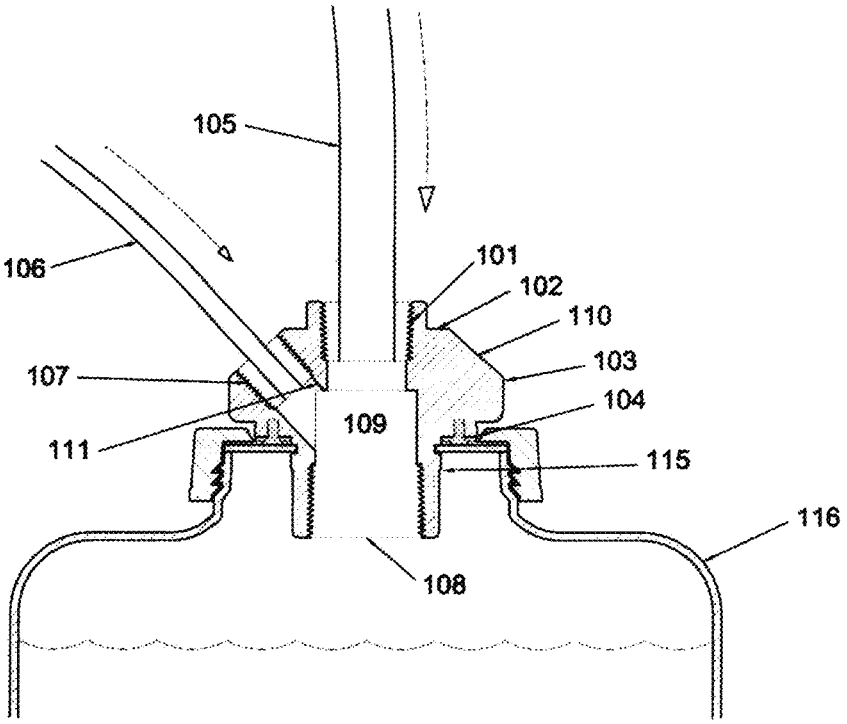
FIG. 1 is an illustration of the universal manifold of the present invention as configured for collecting.

The universal manifold (100) of which is represented in FIG. 1 for the purpose of collecting, where the universal manifold (100) is smartly configured and attached to a storage container (116) to enable the collection of chemical liquids from an HPLC machine to a storage container (116). Such universal manifold (100) is constructed out of polypropylene, plastic, steel or any ridged material and includes a main receiving port (101) that contains a means for attaching a main supply tube (105) which is located proximal to the main receiving port (101). The main receiving port (101) continues to extend cylindrically through the universal manifold (100) to the distal end (108) of the universal manifold (100) thereby providing a main transportation port (109) for transporting chemical liquid to the distal end (108) of the universal manifold (100). The distal end (108) of the universal manifold (100) is presented to the fill aperture (115) of the storage container (116) such that chemical liquid may travel from the distal end (108) of the universal manifold (100) into the fill aperture (115) of the storage container (116).

On the exterior of the universal manifold (100), near the proximal end, a mating surface (102) is provided which extends perpendicular to the main transportation port (109) and provides a surface where the main receiving port (101) ends. The distal end of the mating surface (102) meets with a sloped multi-port receiving surface (110) which extends away from the main receiving port (101) at an angle and in a manner to offering a plane that extends throughout the circumference of the universal manifold (100) for additional receiving ports. The angle (111) of the sloped multi-port receiving surface (110) in reference to the mating surface (102) is approximately between one hundred and thirty (130) degrees and one hundred and forty-five (145) degrees. The multi-port receiving surface (110) includes at least one additional receiving port (107). A number of additional receiving ports may be added to the universal manifold (100) as long as the diameter of the transportation port (109) is not too small as to restrict chemical liquids from adequately traveling during delivery and collection. As further illustrated one end of the additional receiving port (107) which is proximal to the sloped multi-port receiving surface (110) is configured to enable an additional supply tube (106) to attach thereto and be used for collection. The additional receiving port (107) extends perpendicularly away from the sloped multi-port receiving surface (110) and towards the distal end (108) of the universal manifold (100) in a manner that enables the additional transportation port (111) to present an opening into the main transportation port (109). When in use for collecting, the chemical liquid will flow from the additional supply tube (106) to the additional receiving port (107), through the additional transportation port (111) and into the main transportation port (109), through the distal end (108) and through the fill aperture (115) and into the storage container (116). More specifically, when in use for collecting, the chemical liquid will come into contact with the additional receiving port (107), the additional transportation port (111), the main transportation port (109), and the distal end (108).

Figure 2:
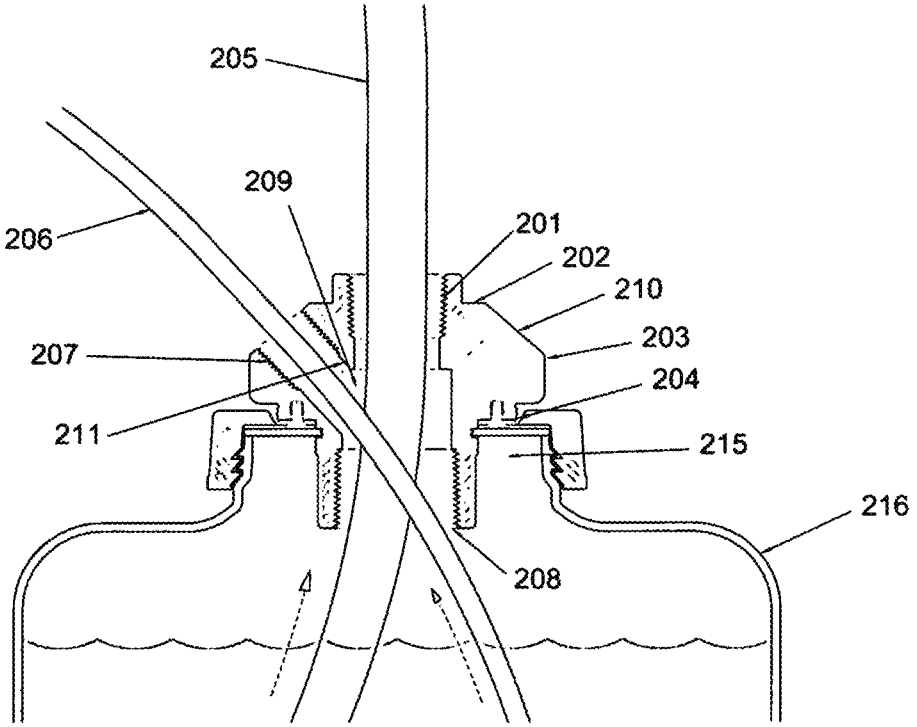
FIG. 2 is an illustration of the universal manifold of the present invention as configured for delivery.

FIG. 2, illustrates universal manifold (200) for the delivery of chemical liquid from a storage container to a machine. When in use for delivery the main receiving port (201) of the universal manifold (200) contains a means for attaching a main supply tube (205) whereby the main receiving port (201) is configured to allow the supply tube (205) to pass through the main receiving port (201), through the main transportation port (209), through the distal end (208), through the fill aperture (215) and into the chemical liquid storage container (216). In use for delivery the chemical liquid through the supply tube (205) and therefore the chemical liquid does not come into contact with the main receiving port (201), the main transportation port (209) and the distal end (208) and the fill aperture (215). Additional receiving port (207), may also be used for delivery as represented in FIG. 2, whereby the additional receiving port (207) is configured to allow the additional supply tube (206) to pass through the additional receiving port (207), through the additional transportation port (211), through the main transportation port (209), through the distal end (208), through the fill aperture (215) and into the storage container (216). In use for delivery, the chemical liquid passes through the additional supply tube (206) therefore the chemical liquid does not come into contact with the additional receiving port (207), additional transportation port (209), the main transportation port (211) and the distal end (208). A number of additional receiving ports may be added to the universal manifold (200) as long as the diameter of the transportation port is not too small as to restrict chemical liquid from adequately traveling during delivery and collection.

Figure 3:
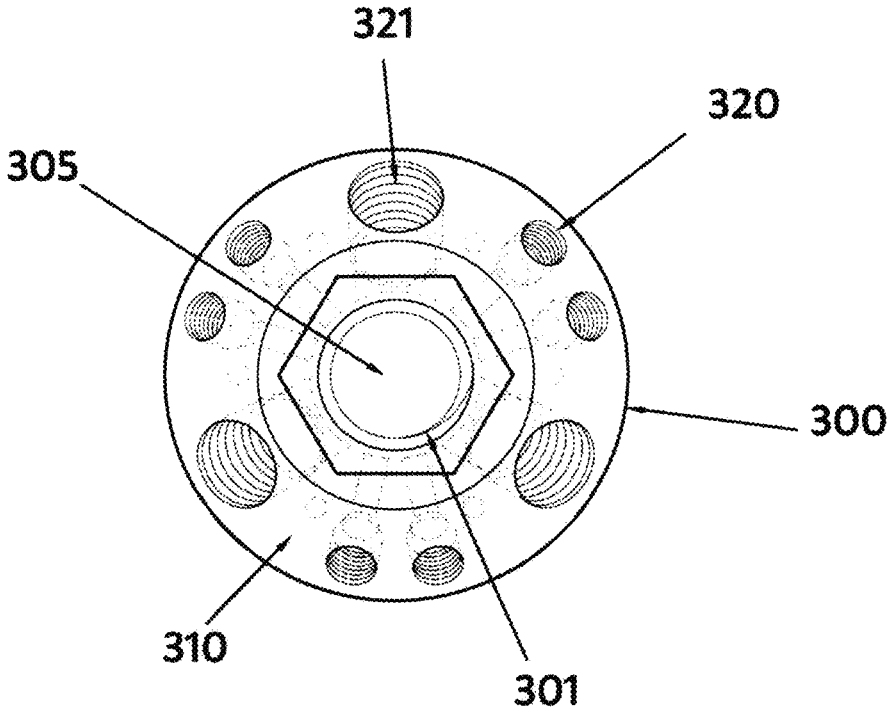
FIG. 3 is an illustration of top view of the universal manifold of the present invention.

FIG. 3 represents a top view of the universal manifold. A main receiving port (301) of which may be threaded to enable the attachment of the main supply tube as represented at the center of FIG. 3. Also, the sloped multi-port receiving surface (310) extends distally throughout the circumference of the universal manifold (300). Additionally, a multitude of ports are represented in FIG. 3 as they are configured throughout the sloped multi-port receiving surface (310). FIG. 3 represents three different sizes of ports (319, 320, and 321) where the largest port being (319). The present invention enables various sizes and numbers of ports only limited by the total surface available on the multi-port receiving surface (310).

Figure 4:
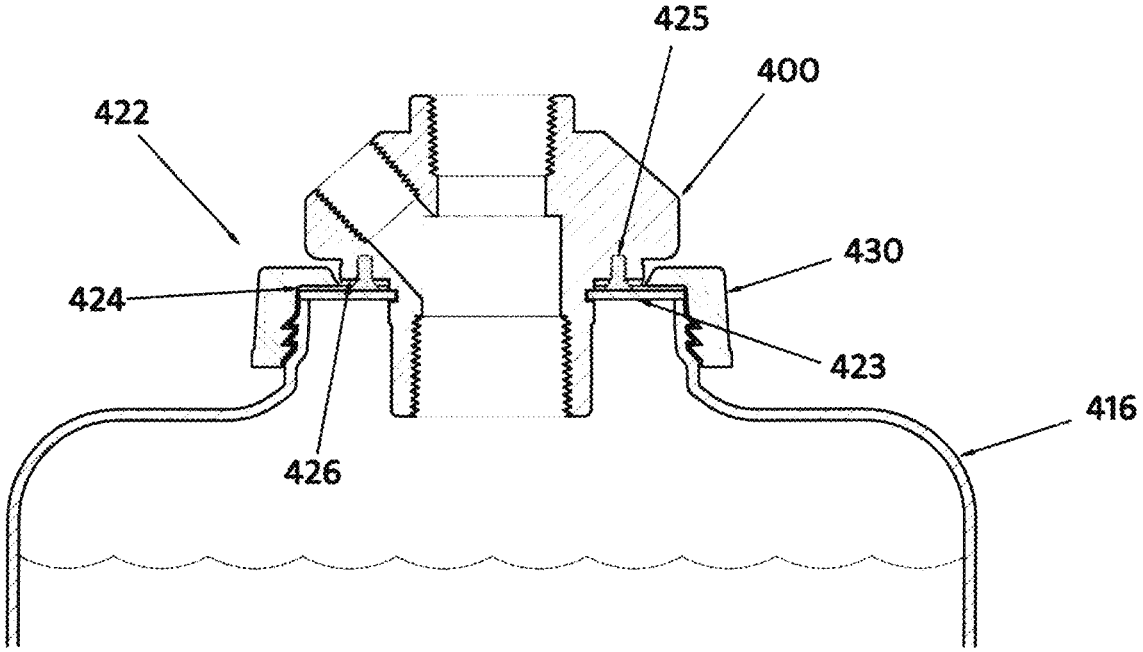
FIG. 4 is an illustration of the matting system of the universal manifold of the present invention.

The mating system which enables the ability for the universal manifold (400) to attach to a wide range of storage containers is represented in FIG. 4. The mating system (401) includes the universal manifold (400) a gasket (423), a universal mating washer (424) a plurality of screws (425) and a mating receiving surface (404) designed to accept the screws (425) while providing a means for securing the mating system (422) to the universal manifold (400). In practice, the mating system (422) is secured onto the mating receiving surface (402) by way of the screws (425) which pass through the gasket (423) and the universal mating washer (424). The particularly innovative part of the present invention is the universal mating washer (424) which enables the universal manifold (400) to attach to the threaded storage container cap (430) for the storage container (416).

Figure 5:
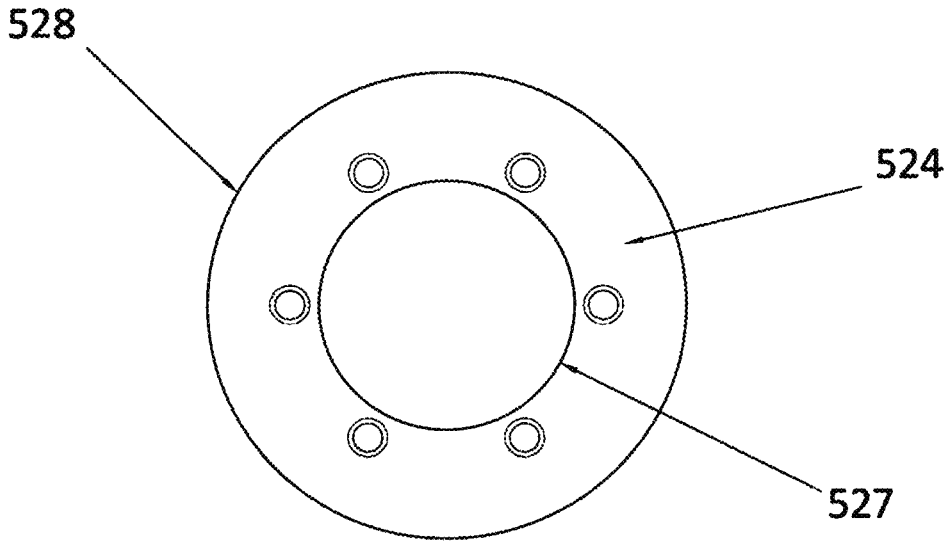
FIG. 5 is an illustration of the exchangeable washer.

Furthermore in practice, as represented in FIG. 5, the universal mating washer (500) includes an inner most surface (501) which resides cylindrically alongside the exterior of the main transportation port and an outer most surface of the universal mating washer (502) which resides along the interior of the threaded cap of the storage container (FIG. 4:416) thereby providing a surface which enables the attachment of the universal manifold to the storage container all while enabling a plurality of ports to supply chemical liquid from a plurality of supply tubes. In the event one needs to attach the universal manifold to a larger storage container, the universal mating washer (500) can be easily replaced by a larger universal mating washer whereby the circumference of the outer most surface of the universal mating washer has been increased such that universal manifold may attach to a range of storage containers with fill holes. In the event one needs to attach the universal manifold to a smaller storage container the universal mating washer can be easily replaced by a smaller universal mating washer whereby the circumference of the outer most surface of the universal mating washer has been decreased. The universal mating washer (524) consists of a rigid material such as poly polypropylene, stainless steel, or other known plastic that provides enough rigidity to enable a rigid mating surface. The limitation of decreasing the size of the universal mating washer (524) as represented in FIG. 4 is based on the outside circumference of the distal end of the main transportation port (409).

Figure 6:
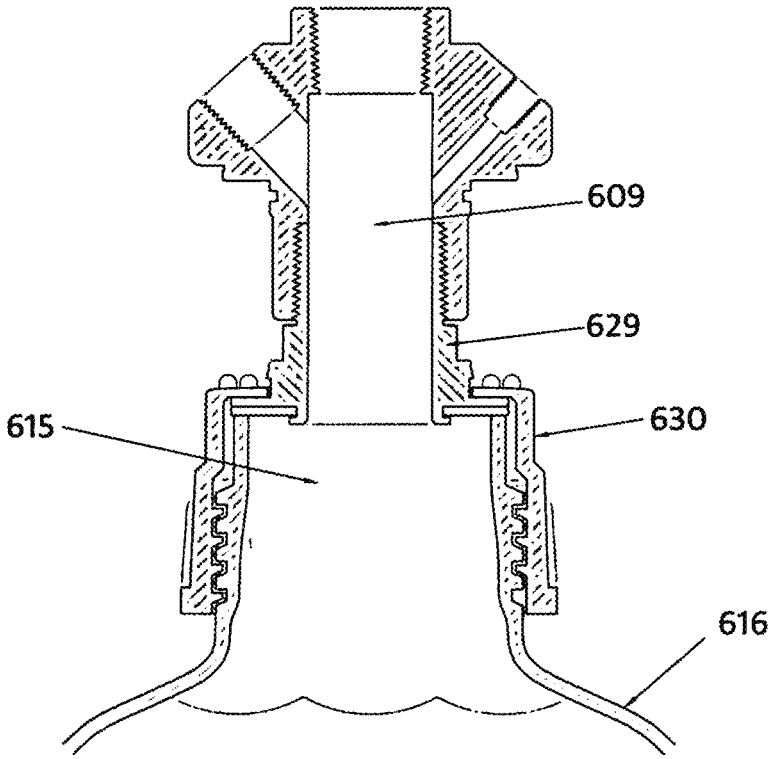
FIG. 6 is an illustration of the manifold adaptor.

In the event one needs to attach the universal manifold to a smaller storage container (616) whereby the fill port on the storage container is smaller than the outside circumference of the distal end of the main transportation port, the distal end is configured as represented in FIG. 6, such that the distal end of the main transportation port (609) may attach to a manifold adaptor (629) which is smartly configured to attach to a storage container cap (630) that attaches to a storage container that includes a fill aperture that is less than the circumference of the distal end of the main transport port (609).

There are several benefits to providing a universal manifold that is enabled to attach multiple supply tubes that supply chemical liquid while enabling the ability to attach the universal manifold to a number of variously sized storage containers. One benefit relates to cost in that one may use one universal manifold and replace the universal mating washer such that the universal mating washer is increased or decreased respectively to enable the universal manifold to it a number of variously sized storage containers. Therefore the universal manifold removes the costly requirement to produce a manifold for each variously sized storage container. Another important benefit is that in the event the storage container is damaged or has reached its shelf life, the universal adaptor can be removed and attached to the new storage container regardless of the new storage container's size. In fact, many times the supply tubes may remain in place as one attaches the universal manifold to the new and variously sized storage container. There are additional benefits that are not described herein but are realized in practice.

What is claimed is:

1. A universal manifold system for the delivery and collection of chemical liquid to and from a storage container; the universal manifold system comprising:

a storage container, with a fill aperture;

a threaded cap, for attaching to the storage container;

a manifold, for receiving a plurality of supply tubes;

a mating receiving surface, for securing the manifold;

a plurality of screws, for securing into the mating receiving surface of the manifold; and a plurality of mating washers, whereby a single mating washer, that corresponds with a size of the fill aperture, is removably fixed to the threaded cap and the mating receiving surface.

2. A universal manifold system of claim 1, whereby the single mating washer may be replaced by a larger mating washer to be removably fixed to a larger threaded cap and the mating receiving surface.

3. A universal manifold system of claim 1, whereby the single mating washer may be replaced by a smaller mating washer to be removably fixed to a smaller threaded cap and the mating receiving surface.

4. A universal manifold system of claim 1, whereby the manifold, comprises a single supply tube.

* * * * *